US009797259B2

(12) United States Patent
Marsh et al.

(10) Patent No.: US 9,797,259 B2
(45) Date of Patent: Oct. 24, 2017

(54) TURBINE AIRFOIL COOLING SYSTEM WITH COOLING SYSTEMS USING HIGH AND LOW PRESSURE COOLING FLUIDS

(71) Applicant: Siemens Energy, Inc., Orlando, FL (US)

(72) Inventors: Jan H. Marsh, Orlando, FL (US); Stephen John Messmann, Charlotte, NC (US); Carmen Andrew Scribner, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 738 days.

(21) Appl. No.: 14/200,168

(22) Filed: Mar. 7, 2014

(65) Prior Publication Data

US 2015/0252688 A1 Sep. 10, 2015

(51) Int. Cl.

| | |
|---|---|
| ***F01D 5/18*** | (2006.01) |
| ***F01D 25/14*** | (2006.01) |
| ***F01D 5/08*** | (2006.01) |
| ***F01D 5/22*** | (2006.01) |

(52) U.S. Cl.

CPC ..... *F01D 5/187* (2013.01); *F01D 5/081* (2013.01); *F01D 5/22* (2013.01); *F01D 25/14* (2013.01); *F01D 5/087* (2013.01); *F05D 2240/81* (2013.01)

(58) Field of Classification Search

CPC ..... F01D 5/087

See application file for complete search history.

(56) References Cited

U.S. PATENT DOCUMENTS

| | | | | |
|---|---|---|---|---|
| 2,931,623 A | | 4/1960 | Hyde | |
| 5,498,126 A | | 3/1996 | Pighetti et al. | |
| 5,971,707 A | * | 10/1999 | Uematsu | F01D 5/18 416/96 R |

(Continued)

FOREIGN PATENT DOCUMENTS

| | | | |
|---|---|---|---|
| CN | 1877083 | A | 12/2006 |
| CN | 101178029 | A | 5/2008 |

(Continued)

OTHER PUBLICATIONS

PCT International Search Report and Written Opinion dated Sep. 14, 2015 corresponding to PCT Application PCT/US2015/019350 filed Mar. 9, 2015 (19 pages).

*Primary Examiner* — Gregory Anderson
*Assistant Examiner* — Juan G Flores

(57) ABSTRACT

A turbine airfoil cooling system including a low pressure cooling system and a high pressure cooling system for a turbine airfoil of a gas turbine engine is disclosed. In at least one embodiment, the low pressure cooling system may be an ambient air cooling system, and the high pressure cooling system may be a compressor bleed air cooling system. In at least one embodiment, the compressor bleed air cooling system in communication with a high pressure subsystem that may be a snubber cooling system positioned within a snubber. A delivery system including a movable air supply tube may be used to separate the low and high pressure cooling subsystems. The delivery system may enable high pressure cooling air to be passed to the snubber cooling system separate from low pressure cooling fluid supplied by the low pressure cooling system to other portions of the turbine airfoil cooling system.

10 Claims, 4 Drawing Sheets

(56) References Cited

U.S. PATENT DOCUMENTS

| | | | | |
|---|---|---|---|---|
| 5,993,150 | A | 11/1999 | Liotta et al. | |
| 6,389,793 | B1 * | 5/2002 | Priestley | F01D 25/12 60/782 |
| 6,487,863 | B1 | 12/2002 | Chen et al. | |
| 6,960,060 | B2 | 11/2005 | Lee | |
| 6,968,696 | B2 | 11/2005 | Little | |
| 7,007,488 | B2 | 3/2006 | Orlando et al. | |
| 7,189,056 | B2 | 3/2007 | Girgis et al. | |
| 7,270,517 | B2 | 9/2007 | Garner | |
| 7,293,953 | B2 | 11/2007 | Leach et al. | |
| 7,513,738 | B2 | 4/2009 | Itzel et al. | |
| 7,677,048 | B1 * | 3/2010 | Brostmeyer | F01D 5/081 415/115 |
| 7,743,613 | B2 | 6/2010 | Lee et al. | |
| 7,870,742 | B2 | 1/2011 | Lee et al. | |
| 7,870,743 | B2 | 1/2011 | Lee et al. | |
| 7,926,289 | B2 * | 4/2011 | Lee | F01D 5/081 415/145 |
| 8,157,505 | B2 | 4/2012 | Liang | |
| 8,172,507 | B2 | 5/2012 | Liang | |
| 8,313,287 | B2 | 11/2012 | Little | |
| 2011/0194939 | A1 | 8/2011 | Marra | |
| 2011/0194943 | A1 | 8/2011 | Mayer et al. | |
| 2014/0056716 | A1 | 2/2014 | Messmann et al. | |
| 2015/0118062 | A1 * | 4/2015 | Pierre | B23P 15/04 416/96 R |

FOREIGN PATENT DOCUMENTS

| | | | |
|---|---|---|---|
| CN | 102656338 | A | 9/2012 |
| EP | 0860586 | A2 | 8/1998 |
| EP | 1921255 | A2 | 5/2008 |
| JP | S56143302 | A | 11/1981 |
| JP | 2013515893 | A | 5/2013 |
| WO | 2010001655 | A1 | 12/2011 |

* cited by examiner

TURBINE AIRFOIL COOLING SYSTEM WITH COOLING SYSTEMS USING HIGH AND LOW PRESSURE COOLING FLUIDS

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention

FIELD OF THE INVENTION

This invention is directed generally to turbine engines, and more particularly to cooling fluid feed systems with ambient cooling air for turbine airfoils in gas turbine engines

BACKGROUND

Typically, gas turbine engines include a compressor for compressing air, a combustor for mixing the compressed air with fuel and igniting the mixture, and a turbine blade assembly for producing power Combustors often operate at high temperatures that may exceed 2,500 degrees Fahrenheit Typical turbine combustor configurations expose turbine blade assemblies to these high temperatures As a result, turbine blades and turbine vanes must be made of materials capable of withstanding such high temperatures. Turbine blades, vanes and other components often contain cooling systems for prolonging the life of these items and reducing the likelihood of failure as a result of excessive temperatures Typically, turbine vanes extend radially inward from a vane carrier and terminate within close proximity of a rotor assembly, and turbine blades extend radially outward and terminate within close proximity of the vane carrier The turbine vanes and blades typically include a plurality of cooling channels positioned in internal aspects therein to cool the vanes and blades from heat acquired from the combustor exhaust gases Some large turbine blades are no different and require internal cooling systems as well. In addition, large turbine blades, particularly of the larger downstream stages, may include snubbers extending between adjacent blades for structural support The snubbers may include internal cooling systems to cool the outer walls forming the snubbers As the engines run at ever increasing loads, a need exists for novel cooling systems for the turbine airfoils and snubbers that reduce inefficiencies of conventional cooling systems.

SUMMARY OF THE INVENTION

A turbine airfoil cooling system including a low pressure cooling system and a high pressure cooling system for a turbine airfoil of a gas turbine engine is disclosed In at least one embodiment, the low pressure cooling system may be an ambient air cooling system, and the high pressure cooling system may be a compressor bleed air cooling system In at least one embodiment, the compressor bleed air cooling system in communication with a high pressure subsystem that may be a snubber cooling system positioned within a snubber. A delivery system including a movable air supply tube may be used to separate the low and high pressure cooling subsystems The delivery system may enable high pressure cooling air to be passed to the snubber cooling system separate from low pressure cooling fluid supplied by the low pressure cooling system to other portions of the turbine airfoil cooling system In at least one embodiment, the cooling system may direct cooling fluids from a compressor to a snubber cooling system to cool the snubber cooling system, and the cooling system may direct cooling fluids from an ambient air source to an ambient air cooling system within an airfoil to cool other aspects of the airfoil The snubber cooling system may be in communication with the compressor bleed air cooling system for receiving compressor bleed air. The snubber cooling system may be positioned within a snubber and may extend to an under root slot The ambient air cooling system may be in fluid communication with an ambient air source for providing ambient air to portions of the airfoil cooling system other than the snubber cooling system The compressor bleed air cooling system may be in fluid communication with the compressor for providing compressor bleed air to the snubber cooling system As such, the compressor bleed air and the ambient air remain separated when used in the airfoil cooling system.

The cooling system may be positioned at least partially in a turbine airfoil that may be formed from a generally elongated hollow airfoil formed from an outer wall and having a leading edge, a trailing edge, a pressure side, a suction side, a root at a first end of the airfoil and a tip at a second end opposite to the first end, and an airfoil cooling system positioned within interior aspects of the generally elongated hollow airfoil The turbine airfoil may include a snubber extending from the outer wall forming the generally elongated hollow airfoil toward an adjacent turbine airfoil positioned within a row of airfoils including the generally elongated hollow airfoil. The cooling system may also include a snubber cooling system positioned within the snubber and extending to an under root slot The cooling system may include an ambient air cooling system in fluid communication with an ambient air source for providing ambient air to the ambient cooling system in the airfoil The ambient air cooling system may be formed from any appropriate configuration of one or more cooling channels within the turbine airfoil The cooling system may also include a compressor bleed air cooling system in fluid communication with a compressor and with the snubber cooling system for providing compressor bleed air to the snubber cooling system.

In at least one embodiment, the compressor bleed air cooling system may be in fluid communication with a compressor that feeds compressor bleed air to a turbine of a gas turbine engine in which the turbine airfoil is mounted The compressor may be positioned upstream from the turbine and upstream from a combustor of the turbine engine. In another embodiment, the compressor bleed air cooling system may be in fluid communication with a secondary compressor not in fluid communication with a turbine of a gas turbine engine in which the turbine airfoil is mounted In at least one embodiment, the secondary compressor may be an external compressor fan that may be activated when desired to pressurize incoming ambient air to cool the snubber The secondary compressor may be in addition to the compressor that feeds compressor bleed air to the turbine of a gas turbine engine in which the turbine airfoil is mounted.

In at least one embodiment, the cooling system may include an under root slot positioned radially inward of the root of the generally elongated airfoil and a compressor air manifold positioned radially inward of the root of the generally elongated airfoil The compressor air manifold may be positioned radially inward of the under root slot and may be positioned in a disc. The cooling system may also include one or more movable air supply tubes having an inlet in the compressor air manifold and an outlet movable between engagement with a channel within the generally elongated airfoil and nonengagement with the channel in which the outlet resides in the under root slot The movable air supply tube may also include a collar positioned adjacent the inlet that is adapted to mate with an inner wall forming the compressor air manifold to seal the movable air supply tube to the compressor air manifold when the movable air supply tube contains compressor bleed air The outlet of the movable air supply tube may also include a chamfered outer edge to facilitate the movable air supply tube engaging the channel within the generally elongated airfoil. The channel within the generally elongated airfoil and the movable air supply tube may have outer surfaces that do not contact inner surfaces of the outer wall forming the generally elongated hollow airfoil.

In another embodiment, the turbine airfoil may include a low pressure air cooling system in fluid communication with a low pressure air source and in communication with a low pressure subsystem of the airfoil cooling system in the generally elongated hollow airfoil to provide low pressure cooling air to the airfoil cooling system. The turbine airfoil may also include a high pressure cooling system in fluid communication with a high pressure air source and a high pressure cooling subsystem of the airfoil cooling system for providing high pressure cooling air to the high pressure cooling subsystem, wherein the high pressure cooling air has a higher pressure than the low pressure cooling air. In at least one embodiment, the high pressure cooling subsystem may be formed from the snubber cooling system In at least one embodiment, the low pressure air cooling system may be an ambient air cooling system in fluid communication with an ambient air source and in communication with the airfoil cooling system in the generally elongated hollow airfoil to provide ambient air to the airfoil cooling system. The high pressure cooling system may be a compressor bleed air cooling system in fluid communication with a compressor and with the snubber cooling system for providing compressor bleed air to the snubber cooling system.

In another embodiment, the turbine airfoil may include a generally elongated airfoil and airfoil cooling system, as previously set forth, together with a low pressure air cooling system, a high pressure air cooling system and at least one movable air supply tube for coupling the high pressure air cooling system to a high pressure portion of the airfoil cooling system. The movable air supply tube may have an inlet in a compressor air manifold and an outlet movable between engagement with a channel within the generally elongated airfoil and nonengagement with the channel in which the outlet resides in the under root slot An advantage of the turbine airfoil cooling system is that the low pressure cooling system cools a portion of the turbine airfoil while remaining aspects of the turbine airfoil that are not capable of being adequately cooled by the low pressure cooling system are cooled by the high pressure cooling system As such, the amount of high pressure air needed to cool the turbine airfoil is reduced, thereby reducing the inefficiency of using high pressure air produced by the compressor or other components of the turbine engine These and other embodiments are described in more detail below

BRIEF DESCRIPTION OF THE DRAWINGS

The accompanying drawings, which are incorporated in and form a part of the specification, illustrate embodiments of the presently disclosed invention and, together with the description, disclose the principles of the invention

DETAILED DESCRIPTION OF THE INVENTION

Figure 1:
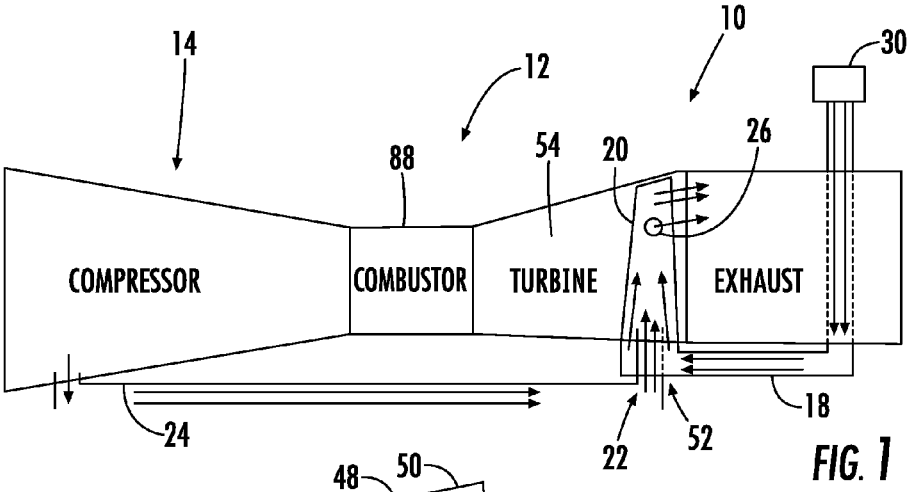
FIG. 1 is a schematic view of a turbine engine with a cooling system formed from a compressor bleed air cooling system that supplies compressor bleed air and an ambient air cooling system that supplies ambient air to a snubber cooling system

As shown in FIGS. 1-7, a turbine airfoil cooling system 10 including a low pressure cooling system 6 and a high pressure cooling system 8 for a turbine airfoil 20 of a gas turbine engine 12 is disclosed In at least one embodiment, the low pressure cooling system 6 may be an ambient air cooling system 18, and the high pressure cooling system 8 may be a compressor bleed air cooling system 24 In at least one embodiment, the compressor bleed air cooling system 24 in communication with a high pressure cooling subsystem 9 that may be a snubber cooling system 16 positioned within a snubber 26. A delivery system 11 including one or more movable air supply tubes 62 may be used to separate the low and high pressure cooling subsystems 7, 9. The delivery system 11 may enable high pressure cooling air to be passed to the snubber cooling system 16 separate from low pressure cooling fluid supplied by the low pressure cooling system 6 to other portions of the turbine airfoil cooling system 10.

In at least one embodiment, the turbine airfoil cooling system 10 for a turbine engine 12 directs high pressure cooling fluids from a high pressure source to a high pressure subsystem 9 and directs low pressure cooling fluids from a low pressure source to a low pressure cooling subsystem 7 within the turbine airfoil 20. In at least one embodiment, the high pressure cooling system 8 may be a compressor bleed air cooling system 24, and the high pressure cooling subsystem 9 may be a snubber cooling system 16. In addition, the low pressure cooling system 6 may be an ambient air cooling system 18, and the low pressure cooling subsystem 7 may be aspects of the turbine airfoil cooling system 10 in the turbine airfoil 20 other than the snubber cooling system 16 As such, the turbine airfoil cooling system 10 for a turbine engine 12 may direct cooling fluids from a compressor 14 to a snubber cooling system 16 and from an ambient air source 30 to the ambient air cooling system 18 to cool other aspects of the turbine airfoil 20

In at least one embodiment, the turbine airfoil cooling system 10 for a turbine engine 12 directs cooling fluids from a compressor 14 to a snubber cooling system 16 The turbine airfoil cooling system 10 may also direct cooling fluid from an ambient air source 30 to the ambient air cooling system 18 to cool other aspects of the turbine airfoil 20 The snubber cooling system 16 may be in communication with a compressor bleed air cooling system 24 for receiving compressor bleed air The snubber cooling system 16 may be positioned within a snubber 26 and may extend to an under root slot 28 The ambient air cooling system 18 may be in fluid communication with an ambient air source 30 for providing ambient air to aspects of the turbine airfoil cooling system 10 within the airfoil 20 other than the snubber cooling system 16. The compressor bleed air cooling system 24 may be in fluid communication with the compressor 14 and with the snubber cooling system 16 for providing compressor bleed air to the snubber cooling system 16 to cool the snubber 26 As such, the ambient air and compressor bleed air remain separated in the turbine airfoil cooling system 10.

Figure 2:
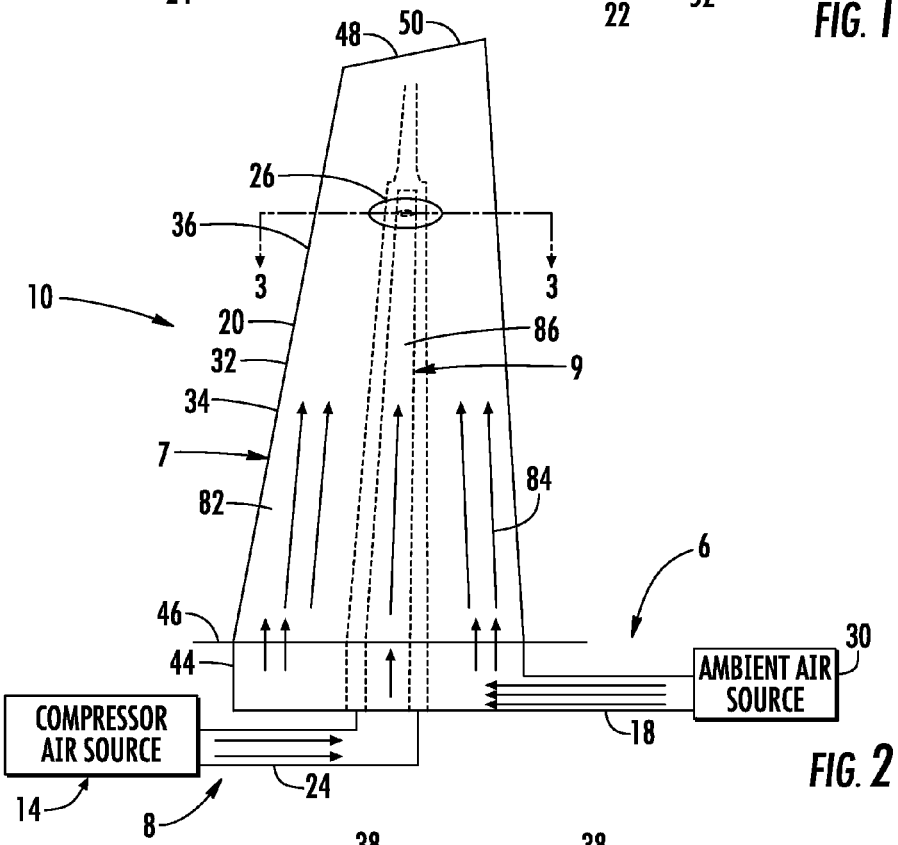
FIG. 2 is a schematic side view of a turbine airfoil including a snubber with a snubber cooling system
Figure 3:
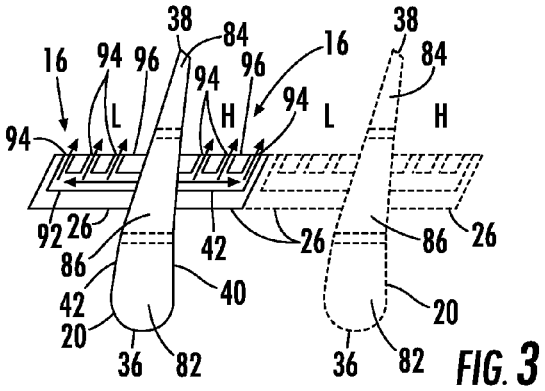
FIG. 3 is a partial cross-sectional view of the turbine airfoil of FIG. 2 showing the snubber cooling system and the snubber cooling system within an adjacent cooling system, taken along section line 3-3.
Figure 4:
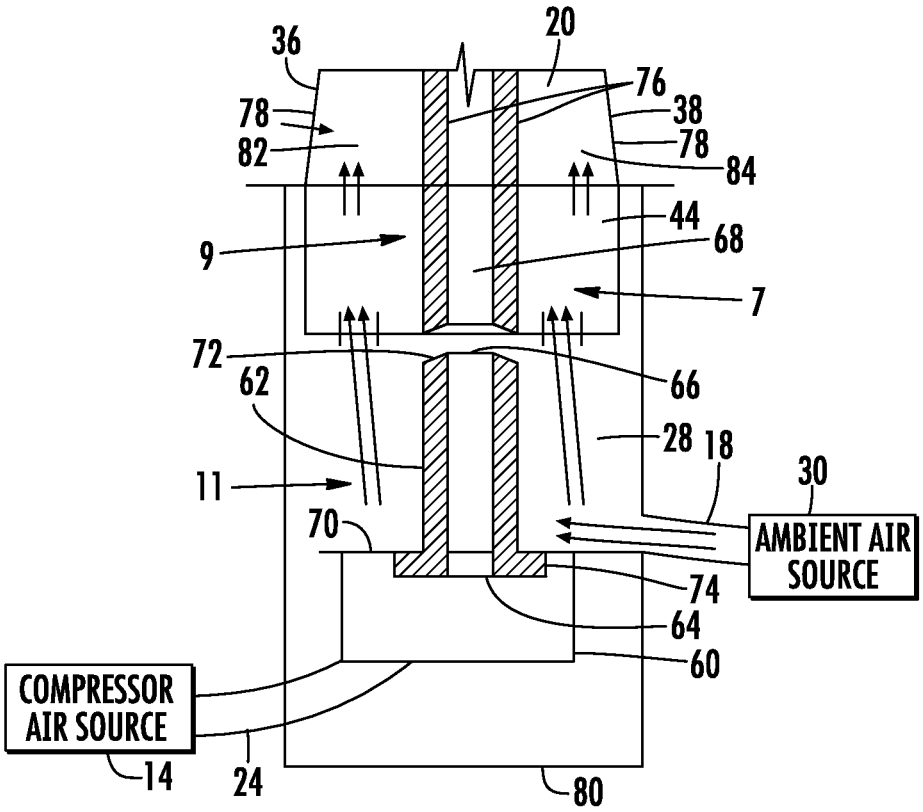
FIG. 4 is a partial cross-sectional view of a root of the turbine airfoil of FIG. 2 with an embodiment of the cooling system.
Figure 6:
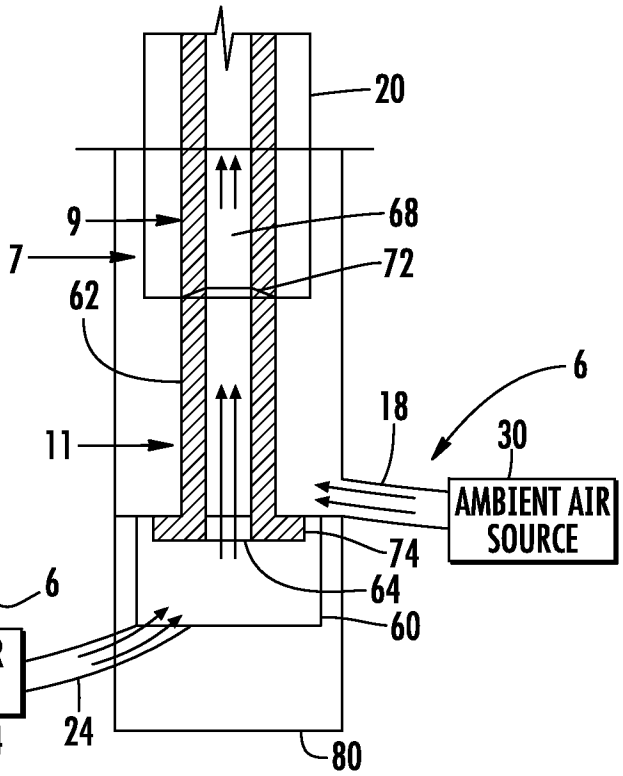
FIG. 6 is a partial cross-sectional front view of a root of a turbine airfoil with the cooling system shown in FIG. 5.
Figure 5:
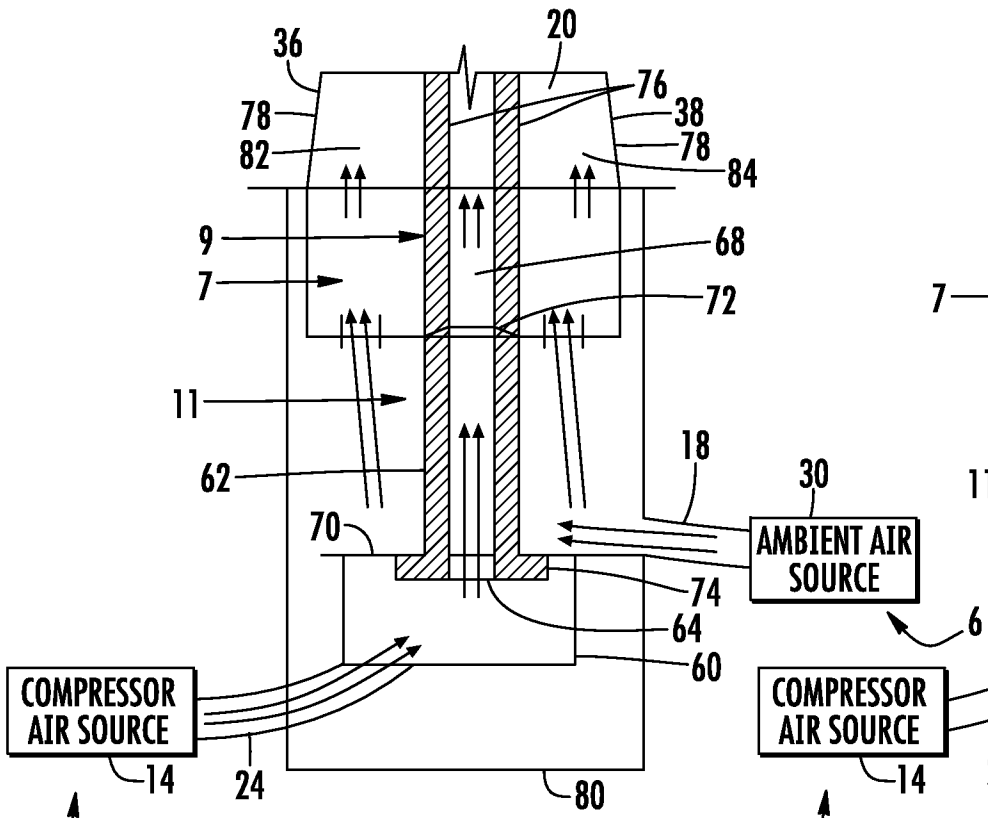
FIG. 5 is a partial cross-sectional side view of a root of a turbine airfoil with the cooling system shown in FIG. 4 in which compressor bleed air is filled in the compressor air manifold and the movable air supply tube is slide radially outward and engaged within the channel

As shown in FIG. 2, the turbine airfoil cooling system 10 may be positioned at least partially in a turbine airfoil 20 that may be formed from a generally elongated hollow airfoil 32 formed from an outer wall 34 and having a leading edge 36, a trailing edge 38, a pressure side 40, a suction side 42, a root 44 at a first end 46 of the airfoil 32 and a tip 48 at a second end 50 opposite to the first end 46, and an airfoil cooling system 10 positioned within interior aspects of the generally elongated hollow airfoil 32. The turbine airfoil 20 may include a snubber 26 extending from the outer wall 34 forming the generally elongated hollow airfoil 32 toward an adjacent turbine airfoil 20 positioned within a row 52 of airfoils 20 including the generally elongated hollow airfoil 32 The cooling system 10 may also include a snubber cooling system 16 positioned within the snubber 26 and extending to an under root slot 28. The turbine airfoil cooling system 10 may include an ambient air cooling system 18 in fluid communication with an ambient air source 30 and with aspects of the turbine airfoil cooling system 10 not in the high pressure cooling system 8 or the snubber cooling system 16. The ambient air cooling system 18 may be formed from any appropriate configuration of one or more cooling channels within the turbine airfoil 20 The cooling system 10 may also include a compressor bleed air cooling system 24 in fluid communication with a compressor 14 and with the snubber cooling system 16 for providing compressor bleed air to the snubber cooling system 16 to cool the snubber 26

The turbine airfoil cooling system 10 within the airfoil 20 may be, but is not limited to being, formed from a three radially extending channel system, as shown in FIG. 2. At points radially outward of the snubber 26, the turbine airfoil cooling system 10 may be reduced to two radially extending channels formed by a leading edge cooling channel 82 and a trailing edge cooling channel 84. A middle cooling channel 86 may be positioned between the leading edge cooling channel 82 and the trailing edge cooling channel 84 and may feed the snubber cooling system 16 with compressed air. The middle cooling channel 86 may be tapered moving radially outward and may terminate at the snubber 26. As such, the radially inward portion of the airfoil 20 includes a three pass cooling system and the radially outward portion of the airfoil 20 includes a two pass cooling system The snubber cooling system 16 may extend throughout each snubber 26 extending from the pressure side 40 and the suction side 42 of the airfoil 20. The snubber cooling system 16 may be formed from a laterally extending channel 92 coupled to a plurality of exhaust outlets 94 that terminate on a downstream side 96 of the snubber 26. In at least one embodiment, the snubber cooling system 16 may be formed from three exhaust outlets 94 within the snubber cooling system 16. In at least one embodiment, the snubber 26 may be formed from a tubular shaped housing In at least one embodiment, as shown in FIG. 1, the compressor bleed air cooling system 24 may be in fluid communication with a compressor 14 that feeds compressor bleed air to a turbine 54 of a gas turbine engine 12 in which the turbine airfoil 20 is mounted The compressor 14 may be positioned upstream from the turbine 54 and upstream from a combustor 88 of the turbine engine 12. The compressor bleed air cooling system 24 may receive compressor air from early stages of the compressor 14

Figure 7:
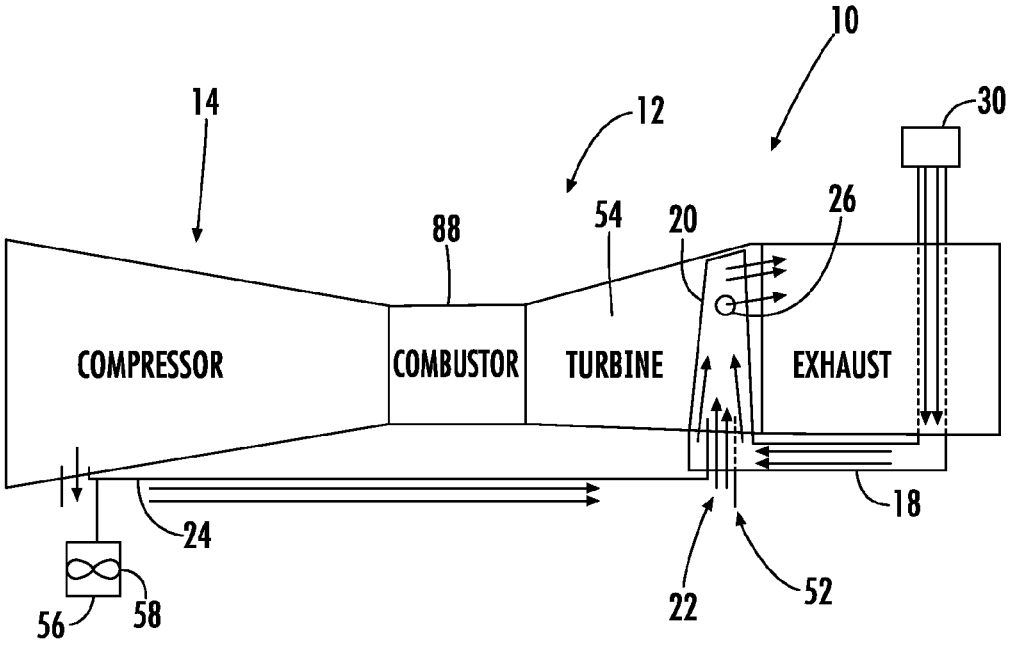
FIG. 7 is a schematic view of another embodiment of a turbine engine with a cooling system formed from a compressor bleed air cooling system that supplies compressor bleed air and an ambient air cooling system that supplies ambient air to a snubber cooling system.

In another embodiment, as shown in FIG. 7, the compressor bleed air cooling system 24 may be in fluid communication with a secondary compressor 56 not in fluid communication with a turbine 54 of a gas turbine engine 12 in which the turbine airfoil 20 is mounted In at least one embodiment, the secondary compressor 56 may be an external compressor fan 58 that may be activated when desired to create a pumping action for the ambient air cooling system 18. The secondary compressor 56 may be in addition to the compressor 14 that feeds compressor bleed air to the turbine 54 of a gas turbine engine 12 in which the turbine airfoil 20 is mounted. The secondary compressor 56 may be used to pressurize all of the ambient air used within the ambient air cooling system 18 to cool the turbine airfoil 20, or only a portion of the cooling air used within the snubber cooling system 16

As shown in FIGS. 2-6, the turbine airfoil cooling system 10 may include a delivery system 11 for delivering high pressure cooling fluids to the high pressure cooling subsystem 9. In at least one embodiment, the delivery system 11 may include an under root slot 28 positioned radially inward of the root 44 of the generally elongated airfoil 32 and a compressor air manifold 60 positioned radially inward of the root 44 of the generally elongated airfoil 32. The compressor air manifold 60 may be positioned radially inward of the under root slot 28 in a disc 80. The turbine airfoil cooling system 10 may also include one or more movable air supply tubes 62 having an inlet 64 in the compressor air manifold 60 and an outlet 66 movable between engagement with a channel 68 within the generally elongated airfoil 32 and nonengagement with the channel 68 in which the outlet 66 resides in the under root slot 28. The movable air supply tube 62 is usable to enable assembly In at least one embodiment, the turbine airfoil cooling system 10 may include a fixed conduit instead of the movable air supply tube 62.

The movable air supply tube 62 may also include a collar 74 positioned adjacent the inlet 64 that is adapted to mate with an inner wall 70 forming the compressor air manifold 60 to seal the movable air supply tube 62 to the compressor air manifold 60 when the movable air supply tube 62 contains compressor bleed air The outlet 66 of the movable air supply tube 62 may also include a chamfered outer edge 72 to facilitate the movable air supply tube 62 engaging the channel 68 within the generally elongated airfoil 32. The channel 68 within the generally elongated airfoil 32 and the movable air supply tube 62 may have outer surfaces 76 that do not contact inner surfaces 78 of the outer wall 34 forming the generally elongated hollow airfoil 32.

During operation of the turbine engine 12, cooling fluids may be supplied to the cooling system 10 In connection with at least one aspect of the cooling system 10, ambient air from the ambient air source 30 may be passed from the source 30 into the ambient air cooling system 18 and into low pressure cooling subsystem 7 in the turbine airfoil 20 High pressure cooling fluids, such as, but not limited to compressor bleed air, may be passed to the high pressure cooling subsystem 9, such as the snubber cooling system 16 to cool the snubber 26 in airfoils in which an all ambient air cooling system would be inadequate to cool the snubbers 26.

In at least one embodiment, the compressor bleed air may be collected within the compressor air manifold 60 positioned within the disc 80 supporting the turbine airfoil 20 The compressor air manifold 60 may be separated from the root 44 of the turbine airfoil 20 by the under root slot 28 Once compressor bleed air fills the compressor air manifold 60, the movable air supply tube 62 slides through an orifice in the compressor air manifold 60 so that the outlet 66 engages with the channel 68 and the collar 74 surrounding the inlet 64 forms a seal against the inner wall 70 forming the compressor air manifold 60 to seal the movable air supply tube 62 to the compressor air manifold 60 The compressor bleed air may be passed to the snubber cooling system 16 to cool the snubber 26.

The foregoing is provided for purposes of illustrating, explaining, and describing embodiments of this invention Modifications and adaptations to these embodiments will be apparent to those skilled in the art and may be made without departing from the scope or spirit of this invention

We claim:

1. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and an airfoil cooling system positioned within interior aspects of the generally elongated hollow airfoil;

a snubber extending from the outer wall forming the generally elongated hollow airfoil toward an adjacent turbine airfoil positioned within a row of airfoils including the generally elongated hollow airfoil;

a snubber cooling system positioned within the snubber and extending to an under root slot, wherein the under root slot is positioned radially inward of the root of the generally elongated airfoil;

an ambient air cooling system in fluid communication with an ambient air source and in communication with the airfoil cooling system in the generally elongated hollow airfoil to provide ambient air to the airfoil cooling system;

a compressor bleed air cooling system in fluid communication with a compressor and with the snubber cooling system for providing compressor bleed air to the snubber cooling system; and a compressor air manifold positioned radially inward of the root of the generally elongated airfoil, wherein the compressor air manifold is positioned radially inward of the under root slot in a disc;

at least one movable air supply tube having an inlet in the compressor air manifold and an outlet movable between engagement with a channel within the generally elongated airfoil and nonengagement with the channel in which the outlet resides in the under root slot.

2. The turbine airfoil of claim 1, wherein the compressor in fluid communication with the compressor bleed air cooling system feeds compressor bleed air to a turbine of a gas turbine engine in which the turbine airfoil is mounted.

3. The turbine airfoil of claim 1, wherein the compressor in fluid communication with the compressor bleed air cooling system is a secondary compressor not in fluid communication with a turbine of a gas turbine engine in which the turbine airfoil is mounted.

4. The turbine airfoil of claim 1, wherein the at least one movable air supply tube further comprises a collar positioned adjacent the inlet adapted to mate with an inner wall forming the compressor air manifold to seal the at least one movable air supply tube to the compressor air manifold when the at least one movable air supply tube contains compressor air.

5. The turbine airfoil of claim 4, wherein the outlet of the at least one movable air supply tube further comprises a chamfered outer edge to facilitate the at least one movable air supply tube engaging the channel within the generally elongated airfoil.

6. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and an airfoil cooling system positioned within interior aspects of the generally elongated hollow airfoil;

a low pressure air cooling system in fluid communication with a low pressure air source and in communication with a low pressure subsystem of the airfoil cooling system in the generally elongated hollow airfoil to provide low pressure cooling air to the airfoil cooling system;

a high pressure cooling system in fluid communication with a high pressure air source and a high pressure subsystem of the airfoil cooling system for providing high pressure cooling air to the high pressure subsystem, wherein the high pressure cooling air has a higher pressure than the low pressure cooling air;

an under root slot positioned radially inward of the root of the generally elongated airfoil and a compressor air manifold positioned radially inward of the root of the generally elongated airfoil; and at least one movable air supply tube having an inlet in the compressor air manifold and an outlet movable between engagement with a channel within the generally elongated airfoil and nonengagement with the channel in which the outlet resides in the under root slot.

7. The turbine airfoil of claim 6, wherein the low pressure air cooling system is an ambient air cooling system in fluid communication with an ambient air source and the low pressure subsystem is the airfoil cooling system in the generally elongated hollow airfoil that provides ambient air to the airfoil cooling system.

8. The turbine airfoil of claim 6, wherein the high pressure cooling system is a compressor bleed air cooling system in fluid communication with a compressor and the high pressure subsystem is a snubber cooling system for providing compressor bleed air to a snubber.

9. The turbine airfoil of claim 6, wherein the at least one movable air supply tube further comprises a collar positioned adjacent the inlet adapted to mate with an inner wall forming the compressor air manifold to seal the at least one movable air supply tube to the compressor air manifold when the at least one movable air supply tube contains compressor air.

10. The turbine airfoil of claim 9, wherein the outlet of the at least one movable air supply tube further comprises a chamfered outer edge to facilitate the at least one movable air supply tube engaging the channel within the generally elongated airfoil.

* * * * *